US011299995B1

(12) United States Patent
Sobanski et al.

(10) Patent No.: US 11,299,995 B1
(45) Date of Patent: Apr. 12, 2022

(54) VANE ARC SEGMENT HAVING SPAR WITH PIN FAIRING

(71) Applicant: RAYTHEON TECHNOLOGIES CORPORATION, Farmington, CT (US)

(72) Inventors: Jon E. Sobanski, Glastonbury, CT (US); Tyler G. Vincent, Portland, CT (US); Bryan P. Dube, Columbia, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/191,121

(22) Filed: Mar. 3, 2021

(51) Int. Cl.
*F01D 9/04* (2006.01)
*F01D 5/18* (2006.01)
*F01D 25/12* (2006.01)

(52) U.S. Cl.
CPC ..... *F01D 9/042* (2013.01); *F01D 5/189* (2013.01); *F01D 25/12* (2013.01); *F05D 2220/323* (2013.01); *F05D 2240/12* (2013.01); *F05D 2240/304* (2013.01); *F05D 2240/81* (2013.01); *F05D 2300/6033* (2013.01)

(58) Field of Classification Search
CPC ..... F01D 9/042; F01D 5/189; F01D 25/12; F05D 2220/323; F05D 2240/12; F05D 2240/304; F05D 2240/81
See application file for complete search history.

(56) References Cited

U.S. PATENT DOCUMENTS

| | | | | |
|---|---|---|---|---|
| 5,372,476 | A | 12/1994 | Hemmelgarn et al. | |
| 6,530,744 | B2 * | 3/2003 | Liotta | F01D 9/041 415/115 |
| 8,015,705 | B2 * | 9/2011 | Wilson, Jr. | F01D 5/189 29/889.721 |
| 10,036,264 | B2 * | 7/2018 | McCaffrey | F01D 9/02 |
| 10,309,240 | B2 * | 6/2019 | Heitman | F01D 9/042 |
| 10,890,076 | B1 * | 1/2021 | Whittle | F01D 25/005 |
| 11,073,039 | B1 * | 7/2021 | Whittle | F01D 9/042 |
| 2016/0177761 | A1 * | 6/2016 | Huizenga | F02C 7/20 415/209.3 |
| 2020/0362709 | A1 * | 11/2020 | Whittle | F01D 5/189 |
| 2021/0108524 | A1 * | 4/2021 | Whittle | F01D 5/282 |
| 2021/0207486 | A1 * | 7/2021 | Sadler | F01D 25/28 |

(Continued)

*Primary Examiner* — Michael Lebentritt
*Assistant Examiner* — Brian Christopher Delrue
(74) *Attorney, Agent, or Firm* — Carlson, Gaskey & Olds, P.C.

(57) ABSTRACT

A vane arc segment includes an airfoil fairing that has first and second fairing platforms and a hollow airfoil section. A spar has a spar platform adjacent the first fairing platform and a hollow spar leg that extends from the spar platform and through the hollow airfoil section. The hollow spar leg has an internal passage for receiving cool air there through, a clevis mount, and a pin fairing. The clevis mount is distal from the spar platform and protrudes from the second fairing platform. The clevis mount includes first and second prongs with aligned holes. A pin extends through the aligned holes. The pin fairing extends over the pin between the first and second prongs for guiding the cooling air around the pin. There is a support platform adjacent the second fairing platform. The pin locks the support platform to the spar leg.

19 Claims, 5 Drawing Sheets

(56) References Cited

U.S. PATENT DOCUMENTS

| | | | | |
|---|---|---|---|---|
| 2021/0231019 | A1* | 7/2021 | Whittle | F01D 9/065 |
| 2021/0332710 | A1* | 10/2021 | White, III | F01D 9/042 |
| 2021/0332756 | A1* | 10/2021 | Sharma | F02C 7/18 |

* cited by examiner

VANE ARC SEGMENT HAVING SPAR WITH PIN FAIRING

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A vane arc segment according to an example of the present disclosure includes an airfoil fairing that has first and second fairing platforms and a hollow airfoil section extending there between. A spar has a spar platform adjacent the first fairing platform and a hollow spar leg that extends from the spar platform and through the hollow airfoil section. The hollow spar leg has an internal passage for receiving cool air there through. The spar leg has a clevis mount that is distal from the spar platform and that protrudes from the second fairing platform. The clevis mount includes first and second prongs with aligned holes and a pin that extends through the aligned holes. A pin fairing extends over the pin between the first and second prongs for guiding the cooling air around the pin. A support platform is adjacent the second fairing platform. The support platform has a through-hole through which clevis mount extends. The pin locks the support platform to the spar leg such that the airfoil fairing is trapped between the spar platform and the support platform.

In a further embodiment of any of the foregoing embodiments, the pin fairing seals the pin from the internal passage.

In a further embodiment of any of the foregoing embodiments, the pin fairing is a cylindrical segment.

In a further embodiment of any of the foregoing embodiments, the pin fairing is planar.

In a further embodiment of any of the foregoing embodiments, the pin fairing includes a bearing surface in contact with the pin.

In a further embodiment of any of the foregoing embodiments, the bearing surface includes a hardcoat.

In a further embodiment of any of the foregoing embodiments, the pin fairing is welded to the first and second prongs.

In a further embodiment of any of the foregoing embodiments, the pin fairing has an apex that defines a throat of the internal passage. The internal passage changing at the apex from converging to diverging.

A spar according to an example of the present disclosure includes a spar platform and a hollow spar leg that extends from the spar platform. The hollow spar leg has an internal passage for receiving cooling air there through. A clevis mount that is distal from the spar platform includes first and second prongs with aligned holes for receiving a pin there through. A pin fairing extends over the aligned holes between the first and second prongs for guiding the cooling air.

In a further embodiment of any of the foregoing embodiments, the pin fairing is a cylindrical segment.

In a further embodiment of any of the foregoing embodiments, the pin fairing is planar.

In a further embodiment of any of the foregoing embodiments, the pin fairing includes a bearing surface.

In a further embodiment of any of the foregoing embodiments, the bearing surface includes a hardcoat.

In a further embodiment of any of the foregoing embodiments, the pin fairing is welded to the first and second prongs.

In a further embodiment of any of the foregoing embodiments, the pin fairing has an apex that defines a throat of the internal passage. The internal passage changing at the apex from converging to diverging.

A gas turbine engine according to an example of the present disclosure includes a compressor section, a combustor in fluid communication with the compressor section, and a turbine section in fluid communication with the combustor. The turbine section has vane arc segments disposed about a central axis of the gas turbine engine. Each of the vane arc segments includes an airfoil fairing having first and second fairing platforms and a hollow airfoil section that extends there between. A spar has a spar platform adjacent the first fairing platform and a hollow spar leg that extends from the spar platform and through the hollow airfoil section. The hollow spar leg has an internal passage for receiving cool air there through. A clevis mount that is distal from the spar platform and that protrudes from the second fairing platform includes first and second prongs with aligned holes and a pin extending through the aligned holes. A pin fairing extends over the pin between the first and second prongs for guiding the cooling air around the pin. A support platform adjacent the second fairing platform, has a through-hole through which clevis mount extends. The pin locks the support platform to the spar leg such that the airfoil fairing is trapped between the spar platform and the support platform.

In a further embodiment of any of the foregoing embodiments, the pin fairing has an apex that defines a throat of the internal passage. The internal passage changing at the apex from converging to diverging.

In a further embodiment of any of the foregoing embodiments, the pin fairing seals the pin from the internal passage.

In a further embodiment of any of the foregoing embodiments, the pin fairing includes a bearing surface in contact with the pin, and the bearing surface includes a hardcoat.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
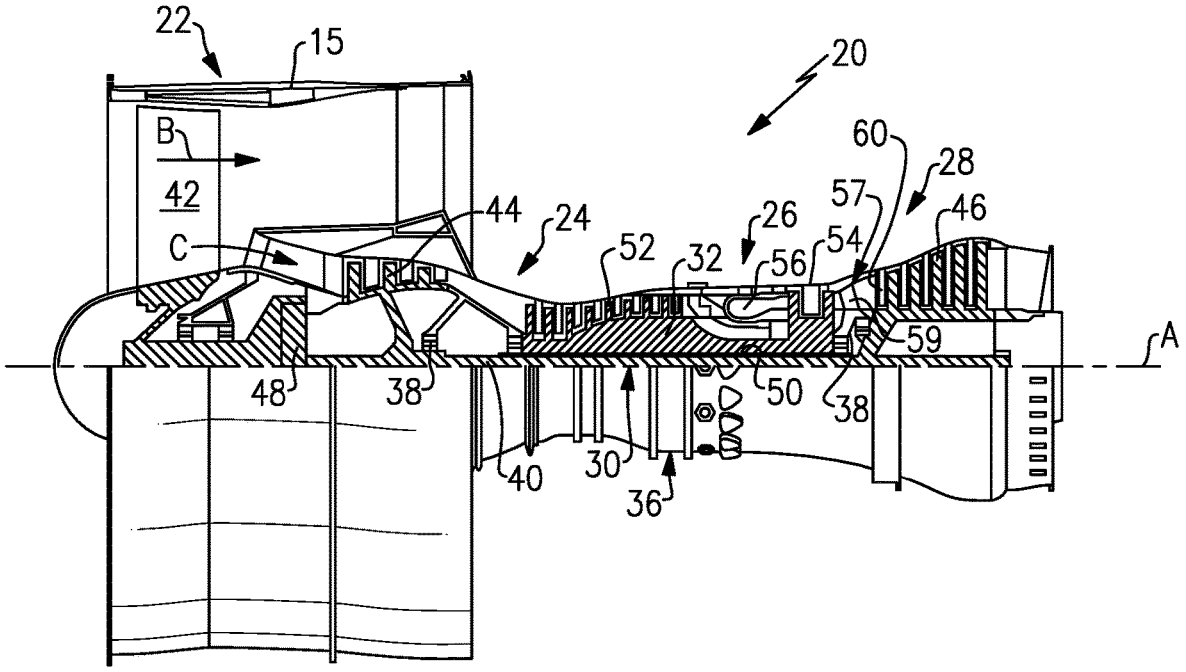
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
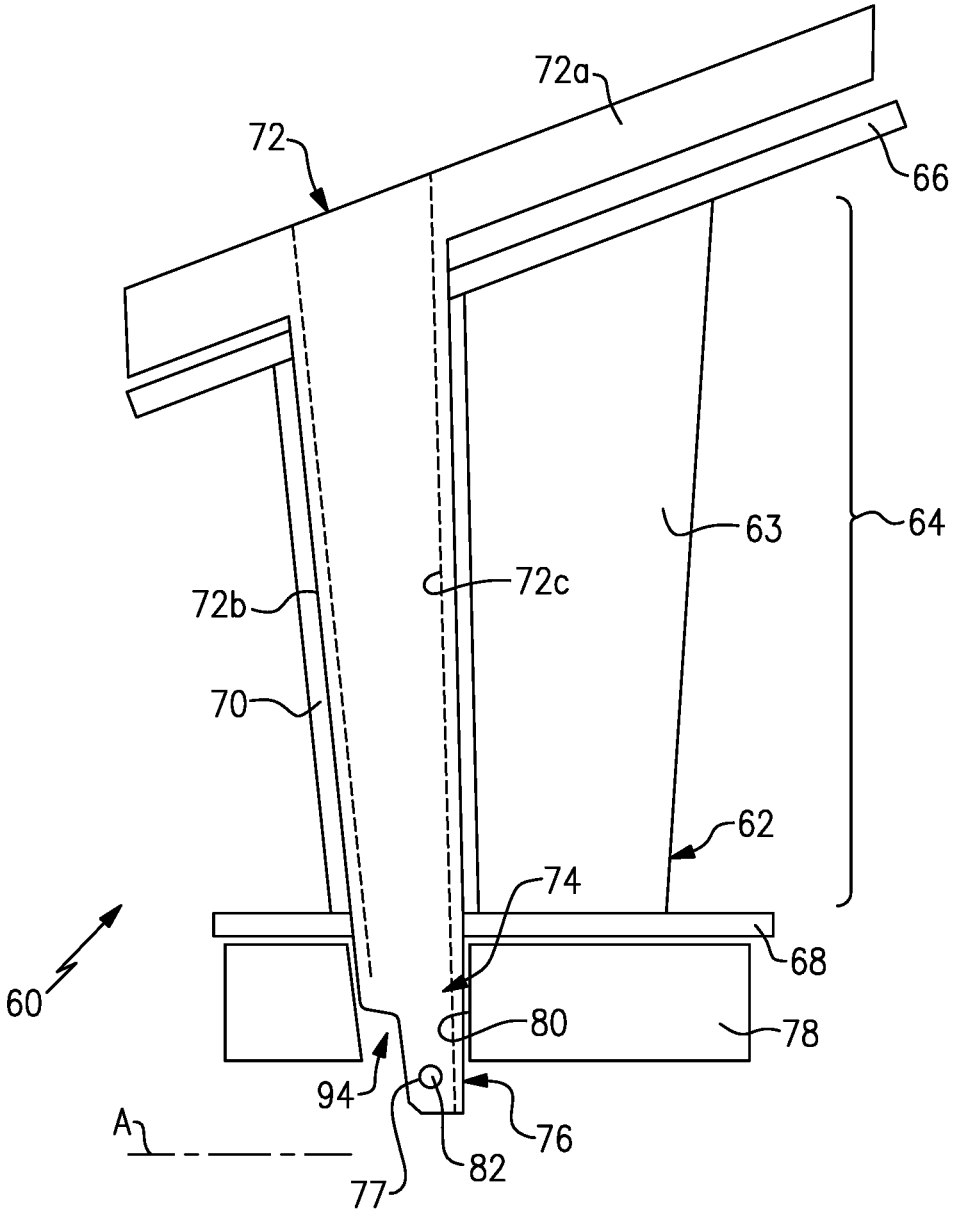
FIG. 2 illustrates a vane arc segment of the gas turbine engine.

FIG. 2 illustrates a line representation of an example of a vane arc segment 60 from the turbine section 28 of the engine 20 (see also FIG. 1). It is to be understood that although the examples herein are discussed in context of a vane from the turbine section, the examples can be applied to other vanes that have support spars.

The vane arc segment 60 includes an airfoil fairing 62 that is formed by an airfoil wall 63. The airfoil fairing 62 is comprised of an airfoil section 64 and first and second platforms 66/68 between which the airfoil section 64 extends. The airfoil section 64 generally extends in a radial direction relative to the central engine axis A. Terms such as "inner" and "outer" used herein refer to location with respect to the central engine axis A, i.e., radially inner or radially outer. Moreover, the terminology "first" and "second" used herein is to differentiate that there are two architecturally distinct components or features. It is to be further understood that the terms "first" and "second" are interchangeable in that a first component or feature could alternatively be termed as the second component or feature, and vice versa.

The airfoil wall 63 is continuous in that the platforms 66/68 and airfoil section 64 constitute a unitary body. As an example, the airfoil wall 63 is formed of a ceramic matrix composite, an organic matrix composite (OMC), or a metal matrix composite (MMC). For instance, the ceramic matrix composite (CMC) is formed of ceramic fiber tows that are disposed in a ceramic matrix. The ceramic matrix composite may be, but is not limited to, a SiC/SiC ceramic matrix composite in which SiC fiber tows are disposed within a SiC matrix. Example organic matrix composites include, but are not limited to, glass fiber tows, carbon fiber tows, and/or aramid fiber tows disposed in a polymer matrix, such as epoxy. Example metal matrix composites include, but are not limited to, boron carbide fiber tows and/or alumina fiber tows disposed in a metal matrix, such as aluminum. A fiber tow is a bundle of filaments. As an example, a single tow may have several thousand filaments. The tows may be arranged in a fiber architecture, which refers to an ordered arrangement of the tows relative to one another, such as, but not limited to, a 2D woven ply or a 3D structure.

The airfoil section 64 circumscribes an interior through-cavity 70. The airfoil section 64 may have a single through-cavity 70, or the cavity 70 may be divided by one or more ribs. The vane arc segment 60 further includes a spar 72 that extends through the through-cavity 70 and mechanically supports the airfoil fairing 62. The spar 72 includes a spar platform 72*a* and a spar leg 72*b* that extends from the spar platform 72*a* into the through-cavity 70. Although not shown, the spar platform 72*a* includes attachment features that secure it to a fixed support structure, such as an engine case. The spar leg 72*b* defines an interior through-passage 72*c*.

The spar leg 72*b* has a distal end portion 74 that has a clevis mount 76. The end portion 74 of the spar leg 72*b* extends past the platform 68 of the airfoil fairing 62 so as to protrude from the fairing 62. There is a support platform 78 adjacent the platform 68 of the airfoil fairing. Although not shown, the support platform 78, the platform 68 of the airfoil fairing 62, or both may have flanges or other mounting features through which the support platform 78 interfaces with the platform 68.

The support platform 78 includes a through-hole 80 through which the end portion 74 of the spar leg 72*b* extends such that at least a portion of the clevis mount 76 protrudes from the support platform 78. The clevis mount 76 includes aligned holes 77 through which a pin 82 extends. The pin 82 is wider than the through-hole 80. The ends of the pin 82 thus abut the face of the support platform 78 and thereby prevent the spar leg 72*b* from being retracted in the through-hole 80. The pin 82 thus locks the support platform 78 to the spar leg 72*b* such that the airfoil fairing 62 is mechanically trapped between the spar platform 72*a* and the support platform 78. It is to be appreciated that the example configuration could be used at the outer end of the airfoil fairing 62, with the spar 72 being inverted such that the spar platform 72*a* is adjacent the platform 68 and the support platform 78 is adjacent the platform 66. The spar 72 may be formed of a relatively high temperature resistance, high strength material, such as a single crystal metal alloy (e.g., a single crystal nickel- or cobalt-alloy).

Cooling air, such as bleed air from the compressor section 24, is conveyed into and through the through-passage 72*c* of the spar 72. This cooling air is destined for a downstream cooling location, such as a tangential onboard injector (TOBI). Cooling air may also be provided into cavity 70 in the gap between the airfoil wall 63 and the spar leg 72*b*. The through-passage 72*c* is fully or substantially fully isolated from the gap. Thus, the cooling air in the through-passage 72*c* does not intermix with cooling air in the gap.

Figure 3:
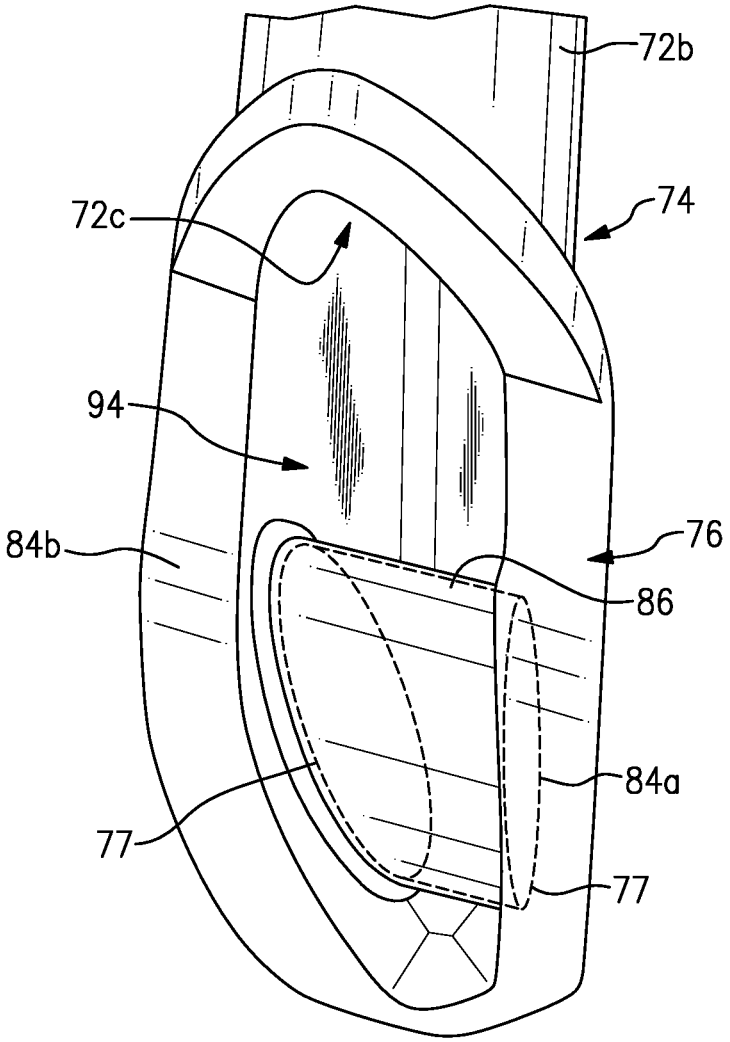
FIG. 3 illustrates a portion of a spar of the vane arc segment.

FIG. 3 illustrates the end portion 74 of the spar leg 72*b* and clevis mount 76. The clevis mount 76 includes first and second prongs 84*a*/84*b*. The prongs 84*a*/84*b* are connected along the trailing end side of the spar leg 72*b* in the illustrated example, although they could alternatively be separated. There is a pin fairing 86 that extends over the region between the prongs 84*a*/84*b* where the pin 82 extends. Once the pin 82 is inserted through the holes 77, the pin fairing 86 extends over the pin 82 and thereby provides an aerodynamic surface over the pin 82 for guiding the cooling air flowing through the through passage 72*c*. Moreover, the pin fairing 86 in this example is integral with the walls of the spar leg 72*b* such that the pin fairing 86 seals the pin 84 from the through-passage 72*c*. Thus, cooling air cannot leak from the through-passage 72*c* at the location of the pin 82.

Figure 4:
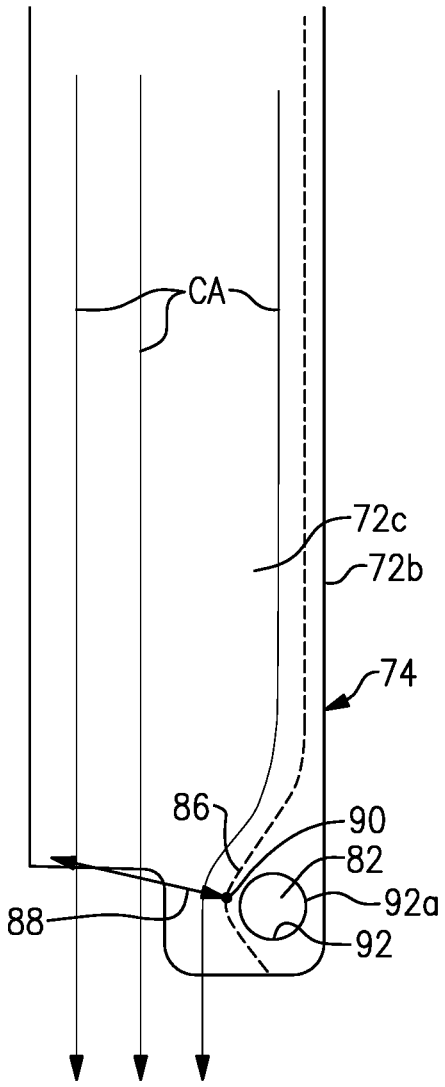
FIG. 4 illustrates cooling air flow over a pin fairing.

The pin fairing 86 has a geometry that facilitates flow of the cooling air over the surface of the pin fairing 86. For instance, in the illustrated example, the pin fairing 86 is a cylindrical segment. The rounded shape of the cylindrical segment avoids abrupt changes in flow direction and thus serves to help reduce pressure loss. As an example, as shown in FIG. 4, cooling air CA flow through the through-passage 72*c* in the spar leg 72*b*. As the cooling air encounters the pin fairing 86, the cooling air gradually turns and flows over the pin fairing 86 before being discharged from the through-passage 72*c*.

The rounded shape of the pin fairing 86 in this example also defines a throat 88 in the through passage 72*c*. The throat 88 represents the minimum cross-sectional flow area of the through-passage 72*c* in the end portion 74. The throat 88 is defined by the apex 90 of the curvature of the pin fairing 86. The through-passage 72*c* changes from converging to diverging at the apex 90. The flow area at the throat 88, the convergence, and the divergence may be selected to modulate the flow of the cooling air through the through-passage 72*c*.

The pin fairing 86 may also serve as a bushing for the pin 82. In this regard, the interior surface of the pin fairing 86 includes a bearing surface 92 in contact with the pin 82. Although the pin 82 may not be designed to substantially translate or rotate, some movement may be expected due to engine vibration. The bearing surface 92 may include a wear-resistance hardcoat 92*a* to reduce wear on the pin fairing 86 and/or pin 82. As an example, the hardcoat 92*a* is a cobalt alloy that is harder than the alloy from which the spar leg 72*b* is made.

The pin fairing 86 may be formed integrally with the other portions of the spar leg 72*b*. For example, the spar leg 72*b* is formed in a process such as, but not limited to, casting or additive manufacturing, and the pin fairing 86 is formed in situ along with the prongs 84*a*/84*b* of the spar leg 72*b* during the process.

Figure 5:
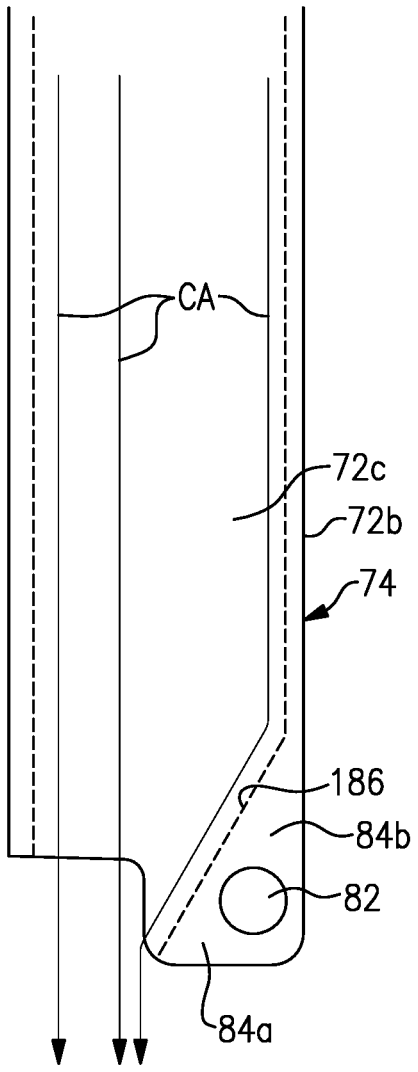
FIG. 5 illustrates another example pin fairing that is substantially planar.

Alternatively, a pin fairing can be pre-fabricated and then attached to the prongs 84*a*/84*b* after formation of the spar leg 72*b*. For example, a pin fairing may be formed from sheet metal or cast separately and then attached over the pin 82. One such example is illustrated in FIG. 5 in which pin fairing 186 is welded to the first and second prongs 84*a*/84*b*. In this example, the pin fairing 186 is formed of sheet metal and is substantially planar. The pin fairing 186 provides a "ramp" to deflect the cooling air in the through-passage 72*c* such that the cooling air flows around the pin 82.

Figure 6:
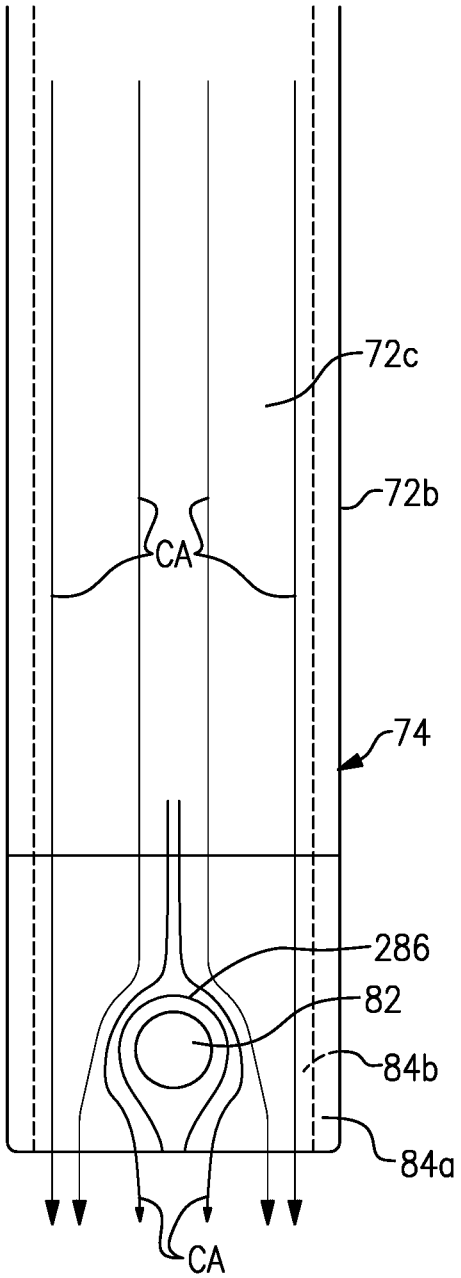
FIG. 6 illustrates a clevis mount with a centrally located pin.

As best shown in FIG. 2, the pin 82 in the illustrated examples is offset toward one side of the spar leg 72*b*. In this case, the pin 82 is offset toward the trailing end side of the spar leg 72*b* and there is an inset 94 at the leading end side such that the leading edges of the prongs 84*a*/84*b* are offset from the leading edge side of the spar leg 72*b*. The inset 94 is open and thus also serves as a portion of the outlet of the through-passage 72*c*. The inset 94 increases the overall area of the outlet of the through-passage 72*c*, in comparison to a straight outlet. It is to be appreciated that the inset 94 and the prongs 84*a*/84*b* may alternatively be flipped such that the prongs 84*a*/84*b* are offset toward the leading edge side of the spar leg 72*b* and the inset is at the trailing edge side of the spar leg 72*b*. FIG. 6 illustrates a modified example in which the pin 82 is centrally located between leading and trailing sides of the spar leg 72*b*. In this case, there is no inset and the pin fairing 286 diverts the cooling air CA forward and aft of the pin 82.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A vane arc segment comprising:

an airfoil fairing having first and second fairing platforms and a hollow airfoil section extending there between;

a spar having a spar platform adjacent the first fairing platform and a hollow spar leg that extends from the spar platform and through the hollow airfoil section, the hollow spar leg having an internal passage for receiving cool air there through, a clevis mount that is distal from the spar platform and that protrudes from the second fairing platform, the clevis mount including first and second prongs with aligned holes and a pin extending through the aligned holes, and a pin fairing extending over the pin between the first and second prongs for guiding the cooling air around the pin; and a support platform adjacent the second fairing platform, the support platform having a through-hole through which clevis mount extends, the pin locking the support platform to the spar leg such that the airfoil fairing is trapped between the spar platform and the support platform.

2. The vane arc segment as recited in claim 1, wherein the pin fairing seals the pin from the internal passage.

3. The vane arc segment as recited in claim 1, wherein the pin fairing is a cylindrical segment.

4. The vane arc segment as recited in claim 1, wherein the pin fairing is planar.

5. The vane arc segment as recited in claim 1, wherein the pin fairing includes a bearing surface in contact with the pin.

6. The vane arc segment as recited in claim 5, wherein the bearing surface includes a hardcoat.

7. The vane arc segment as recited in claim 1, wherein the pin fairing is welded to the first and second prongs.

8. The vane arc segment as recited in claim 1, wherein the pin fairing has an apex that defines a throat of the internal passage, the internal passage changing at the apex from converging to diverging.

9. A spar comprising:

a spar platform and a hollow spar leg that extends from the spar platform, the hollow spar leg having an internal passage for receiving cool air there through, a clevis mount that is distal from the spar platform, the clevis mount including first and second prongs with aligned holes for receiving a pin there through, and a pin fairing extending over the aligned holes between the first and second prongs for guiding the cooling air.

10. The spar as recited in claim 9, wherein the pin fairing is a cylindrical segment.

11. The spar as recited in claim 9, wherein the pin fairing is planar.

12. The spar as recited in claim 9, wherein the pin fairing includes a bearing surface.

13. The spar as recited in claim 12, wherein the bearing surface includes a hardcoat.

14. The spar as recited in claim 9, wherein the pin fairing is welded to the first and second prongs.

15. The spar as recited in claim 9, wherein the pin fairing has an apex that defines a throat of the internal passage, the internal passage changing at the apex from converging to diverging.

16. A gas turbine engine comprising:

a compressor section;

a combustor in fluid communication with the compressor section; and a turbine section in fluid communication with the combustor, the turbine section having vane arc segments disposed about a central axis of the gas turbine engine, each of the vane arc segments includes:

an airfoil fairing having first and second fairing platforms and a hollow airfoil section extending there between, a spar having a spar platform adjacent the first fairing platform and a hollow spar leg that extends from the spar platform and through the hollow airfoil section, the hollow spar leg having an internal passage for receiving cool air there through, a clevis mount that is distal from the spar platform and that protrudes from the second fairing platform, the clevis mount including first and second prongs with aligned holes and a pin extending through the aligned holes, and a pin fairing extending over the pin between the first and second prongs for guiding the cooling air around the pin; and a support platform adjacent the second fairing platform, the support platform having a through-hole through which clevis mount extends, the pin locking the support platform to the spar leg such that the airfoil fairing is trapped between the spar platform and the support platform.

17. The gas turbine engine as recited in claim 16, wherein the pin fairing has an apex that defines a throat of the internal passage, the internal passage changing at the apex from converging to diverging.

18. The gas turbine engine as recited in claim 17, wherein the pin fairing seals the pin from the internal passage.

19. The gas turbine engine as recited in claim 18, wherein the pin fairing includes a bearing surface in contact with the pin, and the bearing surface includes a hardcoat.

* * * * *